US005127154A

United States Patent [19]

Johnson et al.

[11] Patent Number: 5,127,154

[45] Date of Patent: Jul. 7, 1992

[54] METHOD FOR SIZING AND INSTALLING TUBING IN MANIFOLDS

[75] Inventors: G. Leroy Johnson, Lockport; William D. Wright, Lyndonville; Joseph P. DiFonzo, Lewiston, all of N.Y.

[73] Assignee: General Motors Corporation, Detroit, Mich.

[21] Appl. No.: 750,849

[22] Filed: Aug. 27, 1991

[51] Int. Cl.[5] ..... B21D 53/06

[52] U.S. Cl. ..... 29/890.043; 29/525; 29/727; 29/890.08

[58] Field of Search ..... 72/352; 29/890.08, 890.043, 29/726, 727, 407, 525

[56] References Cited

U.S. PATENT DOCUMENTS

| | | | |
|---|---|---|---|
| 2,143,157 | 1/1939 | Kotzebue . | |
| 2,405,478 | 8/1946 | Westin et al. | 72/352 |
| 3,922,768 | 12/1975 | Takayasu | 29/890.043 |
| 3,972,371 | 8/1976 | Plegat | 29/890.043 |
| 4,457,157 | 7/1984 | Masahi et al. | 72/352 |
| 4,601,088 | 7/1986 | Kopczynski . | |
| 4,698,904 | 10/1987 | Nozawa et al. . | |
| 4,761,866 | 8/1988 | Murphy | 29/727 |
| 4,785,516 | 11/1988 | Gilbertson . | |
| 4,830,259 | 5/1989 | Lewis . | |
| 4,930,817 | 6/1990 | Fuchs | 29/890.08 |
| 4,951,371 | 8/1990 | Dalo et al. . | |
| 5,004,047 | 4/1991 | Meier et al. | 29/890.043 |
| 5,040,405 | 8/1991 | Honma et al. | 29/727 |
| 5,046,555 | 9/1991 | Nguyen | 29/890.043 |
| 5,067,235 | 11/1991 | Kato et al. | 29/890.043 |

*Primary Examiner*—Irene Cuda

*Attorney, Agent, or Firm*—Ronald L. Phillips

[57] ABSTRACT

An apparatus sizes tubing, and positions and installs a manifold for single or multi-pass heat exchangers. Tubing is provided which has at least one first end and at least one second end. The first end is sized to a first desired perimeter dimension and, simultaneously, a first manifold is positioned and installed which has a first opening for receiving the first end of the tubing. Additionally, the second end is sized to a second desired perimeter dimension and, simultaneously, a second manifold is positioned and installed which has a second opening for receiving the second end of the tubing. A positioning control aids in the insertion of the ends into the manifolds to the desired depth or pressure. The apparatus is capable of sizing tubing, and positioning and installing manifolds for single or multi-pass heat exchangers having variously dimensioned tubing. The present invention also provides for a method of sizing tubing, and positioning and installing manifolds.

10 Claims, 4 Drawing Sheets

METHOD FOR SIZING AND INSTALLING TUBING IN MANIFOLDS

BACKGROUND OF THE INVENTION

The present invention relates to tubes used in heat exchangers and, more particularly, to an apparatus and method for sizing the tubing and also positioning and installing manifolds to couple flat tubes to round tubes.

In the fabrication of heat exchangers, extruded tubing with internal webs is frequently used to conduct a working fluid through a path in the heat exchanger. Sometimes, numerous tubes are networked together to form a plurality of paths. At each end of the pathway, a means must be provided to channel the working fluid to a common entrance or exit of the heat exchanger. This is often accomplished using a manifold. In one manifold design, the manifold channels the working fluid from two oval extruded tubes to a common round inlet/outlet. It is important that the extruded tubes be inserted into the manifold with the clearance between the tubes and the manifold opening no larger than suitable for the subsequent brazing operation. The manifold must also be installed square with the core and remain so until the braze operation is complete. Unfortunately, the extruded tubing in most instances has dimensional tolerances too large for consistent tube-to-manifold clearance.

In many heat exchangers, the tubes are inserted through a common manifold and brazed to form a one-piece assembly. For satisfactory installation of the manifold, the tubes must be sized down to an acceptable dimension for insertion into the manifold. It is important, too, that the braze joint formed not posses any voids which may form leaks. In particular, heat exchangers are designed to use tubes of various perimeter dimensions. However, the ends of the cut tube must be sized to fit snugly into the hole of an end fitting, regardless of the perimeter dimensional tolerances of the ends of the tubing.

It is seen then that there exists a need for an apparatus and method for sizing tubing and also positioning and installing manifolds to quickly and easily couple tubes having varying perimeter dimensions to various manifolds.

SUMMARY OF THE INVENTION

This need is met by the apparatus and method according to the present invention, wherein an apparatus sizes tubing and also positions and installs a manifold for single and multi-pass heat exchangers.

In accordance with one aspect of the present invention, an apparatus sizes tubing and also positions and installs manifolds. The apparatus comprises tubing, the tubing having a first end and a second end. The first end is sized to a first desired perimeter dimension and, simultaneously, the first end is positioned and installed into a first manifold which has a first opening for receiving the first end of the tubing. Additionally, the second end is sized to a second desired perimeter dimension and, simultaneously, the second end is positioned and installed into a second manifold which has a second opening for receiving the second end of the tubing. Consequently, an advantage of the present invention is that the apparatus is capable of sizing tubing and also positioning and installing manifolds for single or multi-pass heat exchangers having variously dimensioned tubing.

In a preferred embodiment of the present invention, the apparatus may include first and second means comprising first and second tooling means, respectively, each tooling means including bottom tooling and top tooling. The bottom tooling is, preferably, not adjustable, while the top tooling is, preferably, adjustable. If the first and second tooling means comprise the same single set of top and bottom tooling, then the first sizing and the first positioning and installation operations of the first end of the tube are accomplished at a separate time as the second sizing and second positioning and installation operations of the second tube, using the same tooling means. Alternatively, the first and second sizing, and positioning and installation, operations may be performed simultaneously if the first tooling means is separate from the second tooling means.

The present invention also provides for a method of sizing tubing, and positioning and installing manifolds. The method comprises the steps of providing tubing, the tubing having a first end and a second end; and applying first means for simultaneously sizing the first end of the tubing to a first desired perimeter dimension and inserting the first end into a first manifold having a first opening for receiving the first end of the tubing. The method may further include the step of applying second means for simultaneously sizing the second end of the tubing to a second desired perimeter dimension and inserting the second end into a second manifold having a second opening for receiving the second end of the tubing.

The present invention is advantageous in that it simultaneously sizes tubing to any desired perimeter dimension, and positions and installs the tubing into a manifold. The sizing, and the positioning and installation, steps are carried out by tooling means. The tooling means preferably include a tapered section for insertion of the tubing ends, which has the advantage of extruding the tubing ends to desired perimeter dimensions. Since, in most instances, extruded tubing has dimensional tolerances too large for consistent tube-to-manifold clearance, the present invention provides the additional advantage of sizing the extruded tubes to a satisfactory dimension and aligning the tubes with the manifold for insertion. A further advantage of the invention is that it provides for control means which position the tubing ends for quick and accurate installation into the manifolds, and aids in the ejection of the heat exchanger from the sizing and positioning/installation apparatus.

Other objects and advantages of the invention will be apparent from the following description, the accompanying drawings and the appended claims.

DETAILED DESCRIPTION OF THE PREFERRED EMBODIMENTS

In many heat exchangers, tubing is inserted through a common manifold and brazed to form a one-piece assembly. For satisfactory installation of the manifold, the tubes must be sized down to an acceptable dimension for insertion of the manifold. When the tube is installed in the manifold, a brazing operation is required to permanently join the tubing to the manifold. The braze joint that is formed must not possess any voids which form leaks.

Figure 1A:
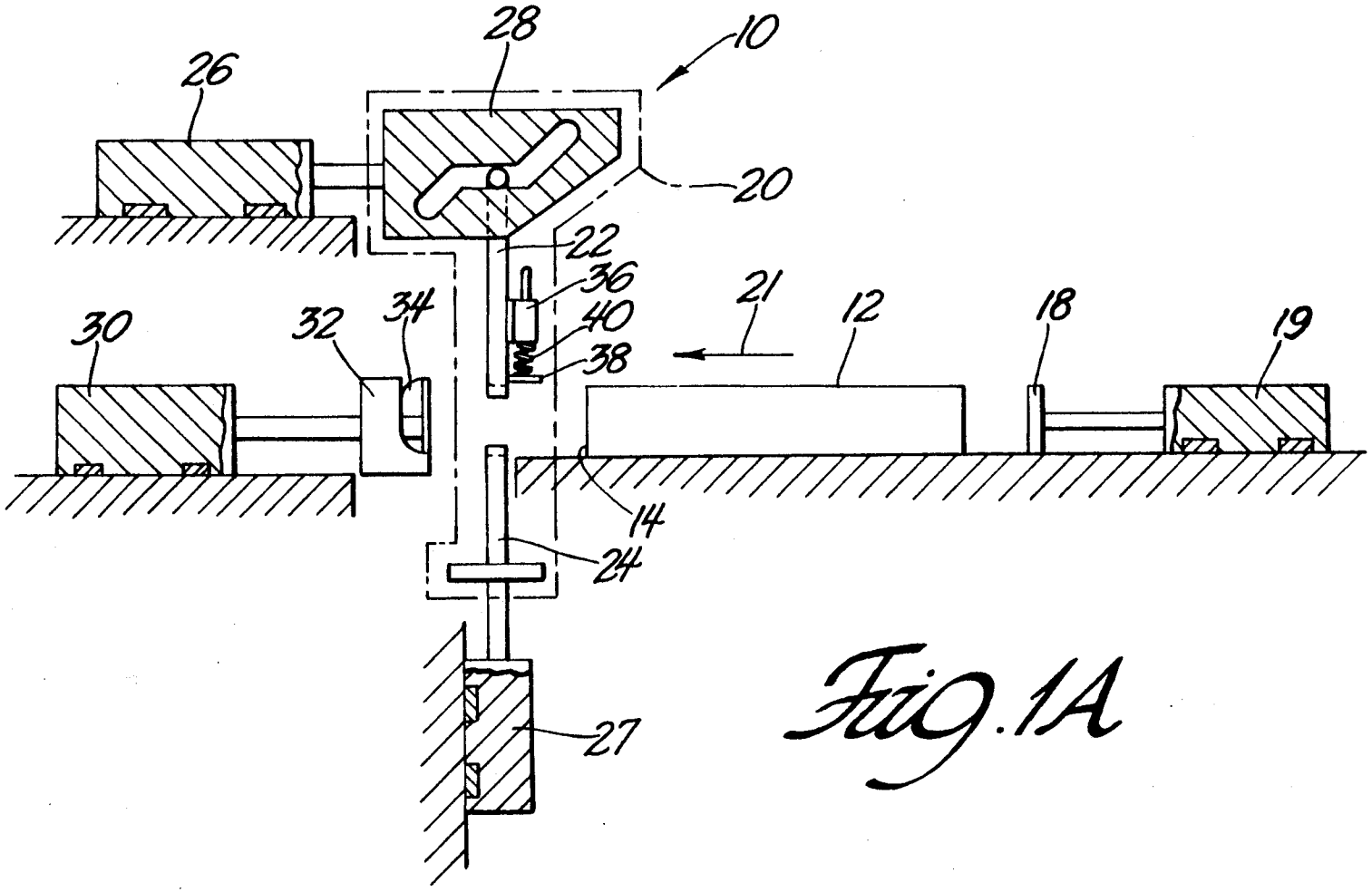
FIGS. 1A and 1B illustrate a side view and a top view, respectively, of an apparatus for sizing tubing, and positioning and installing a manifold for a single or multi-pass heat exchangers.
Figure 1B:
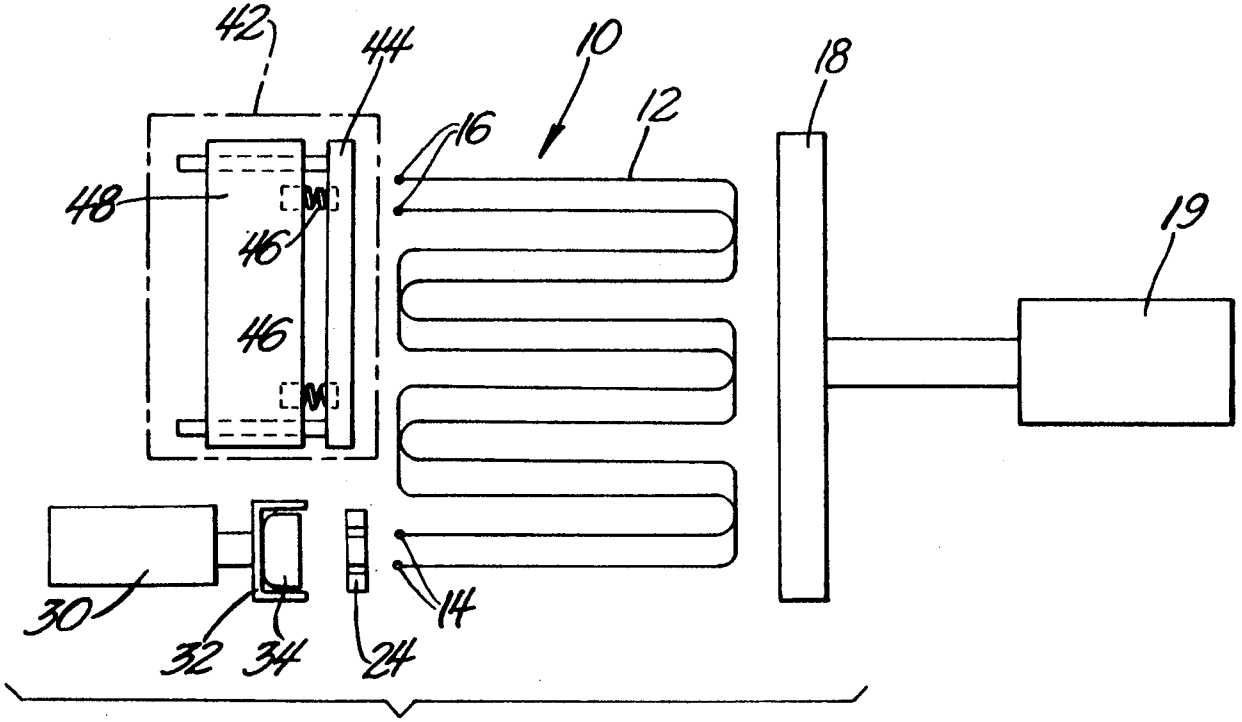

In FIGS. 1A and 1B, an apparatus 10 which sizes tubing to any desired perimeter dimension and also positions and installs manifolds on the sized tubing, is illustrated. A length of tubing 12, having first end or ends 14 and second end or ends 16, is placed on the apparatus 10, to be sized and installed into a manifold. The first end 14 is positioned between a first tooling means 20, comprised of top tooling 22 and bottom tooling 24, for sizing the tubing 12. The positioning can be accomplished by any suitable means including manual or automatic. A ram cylinder 18, operated by a ram actuator 19, then pushes the tubing 12 forward in the direction of arrow 21. Preferably, the height of the bottom tooling 24 is fixed and not adjustable, while the height of the top tooling 22 is adjustable to accommodate various sized tubes. An actuator 26 is used to position the top tooling 22 by employing a stepped cam 28, which can accommodate variously sized desired dimensions of the end or ends 14 of the tubing 12, as described below with reference to FIG. 3. Although the bottom tooling 24 can be removed using an actuator 27, the height of the bottom tooling 2 is preferably not adjustable.

Continuing with FIG. 1A, a manifold actuator 30 has a manifold nest 32 attached thereto for holding a manifold 34. The manifold actuator 30 can extend the nest 32 so the manifold 34 can be loaded thereon. The manifold actuator 30 then retracts the nest 32 holding the manifold 34 until the tubing end 14 has been positioned between the top tooling 22 and the bottom tooling 24. As the tubing end 14 is being positioned and sized at the tooling means 20, the apparatus 10 simultaneously positions and installs the manifold 34 on the sized tubing end or ends 14. The manifold actuator 30 aids in the positioning and installation of the manifold 34 by extending the nest 32 holding the manifold 34 toward the tubing end or ends 14 until the manifold 34 is positioned against the tooling means 20, as best illustrated in FIG. 2D. The tubing end 14 is then inserted into the manifold 34 to a fixed depth or pressure. Ram cylinder 18, operated by ram actuator 19, forces the tubing end or ends 14 through the tooling means 20 and into the manifold 34. Once the manifold 34 is installed, the manifold actuator 30 retracts the nest 32, no longer holding the manifold 34. The top and bottom tooling 22 and 24 retract, and the ram cylinder 18 then retracts, so the tubing 12, installed in the manifold 34, can be removed from the apparatus 10.

When the end or ends 14 of the tubing 12 is extruded by the tooling means 20, the perimeter dimension of the end or ends 14 may be oval in shape, occasionally becoming stuck in the top tooling 22. Hence, when the top tooling 22 is retracted to allow removal of the tubing 12, the end or ends 14 may have an undesirable tendency to retract with the top tooling 22. An optional stripper means 36 may be included in the apparatus 10 to prevent this from happening and to aid in ejecting the end or ends 14 from the top tooling 22. The stripper means 36, illustrated in FIG. 1A, is attached to a reactive force means 38 operated by a spring 40. When the top tooling 22 retracts, the spring 40 extends and causes the reactive force means 38 to push down on the tubing 12, ejecting the end or ends 14 from the top tooling and maintaining the tubing 12 in its proper location.

The sizing and the positioning and installation operations may then be repeated for the second end or ends 16 of the tubing 12, and for as many pieces of tubing as desired. Alternatively, there may be a second tooling means which is a duplicate of first tooling means 20, such that the first and second ends 14 and 16 may be sized, and positioned and installed on first and second manifolds, simultaneously. In yet another embodiment of the present invention, the tubing end or ends 14 may comprise multiple ends 14, such as for a multi-pass heat exchanger, and all of the multiple ends 14 may be sized and positioned and installed simultaneously. Finally, for a multi-pass heat exchanger, having multiple ends 14 and multiple ends 16, all of the ends 14 and 16 may be simultaneously sized, and positioned and installed, if the first and second tooling means are separate, but duplicate, tooling means.

Referring now to FIG. 1B, a top view of the apparatus 10 omitting the top tooling 22 is shown wherein the tubing 12 is a serpentine tube having two first ends 14 and two second ends 16. The ram cylinder 18 can be extended to push the tubing 12 up against a control means 42. The control means 42 positions the ends 14 and 16 of the tubing 12 for installation into the manifold 34, and also controls the insertion depth of the ends 14 and 16 into the manifold 34. The control means 42 comprise stop means 44 which aid in aligning the tubing 12 prior to installation of the manifold 34, and ejector means 46 which aid in the ejection of the tubing 12 after installation of the first manifold 34. The ejector means 46 may comprise one or more springs 46. Finally, the control means 42 comprise a back plate 48.

Once the tubing 12 is properly aligned to allow insertion of the ends 14 between the top tooling 22 and the bottom tooling 24 and into the manifold 34, the ram cylinder 18 pushes against the tubing 12 to force the ends 14 into the manifold 34. The insertion depth of the ends 14 is controlled by the springs 46, which compress as the ram cylinder 18 pushes the tubing 12. When the springs 46 are fully compressed, stop means 44 is positioned against back plate 48, thus stalling the ram cylinder 18. The insertion of the ends 14 into the manifold 34 is then complete. The ram cylinder 18 then retracts, and the springs 46 suddenly extend to their normal state, ejecting the tubing 12 with the manifold 34 installed thereon, out of the tooling means 20.

Figure 2A:
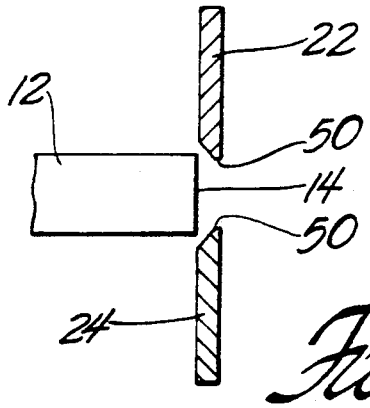
FIGS. 2A through 2D illustrate the sizing and the positioning and installation operations accomplished by the apparatus in FIGS. 1A and 1B.
Figure 2B:
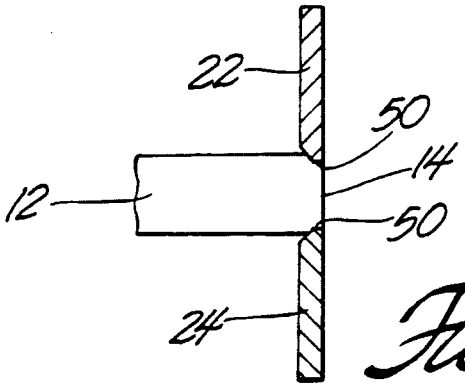
Figure 2C:
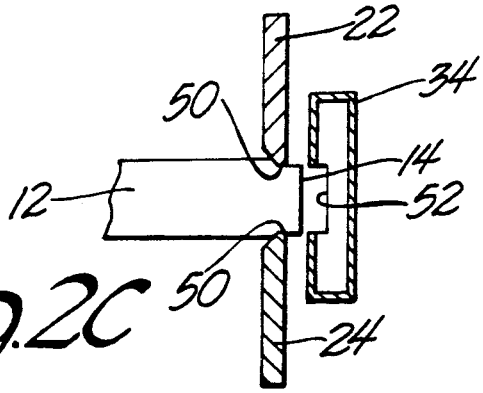
Figure 2D:
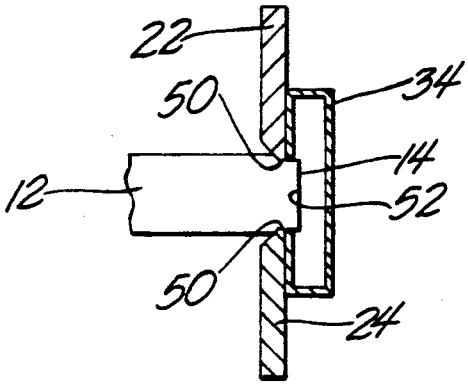

Referring now to FIGS. 2A through 2D, the sequence of the simultaneous sizing and the positioning and installation operations accomplished by the apparatus 10 in FIGS. 1A and 1B are illustrated. In FIG. 2A, the tubing 12 is aligned to slide between the top tooling 22 and the bottom tooling 24 in the direction of arrow 21 of FIG. 1A. The top tooling 22 and the bottom tooling 24 each have a tapered section 50, such that the distance between the top tooling 22 and the bottom tooling 24 is decreased, as illustrated in FIGS. 2B and 2C. As the tubing 12 slides between the top tooling 22 and the bottom tooling 24, the end 14 of the tubing 12 is extruded to a desired perimeter dimension which corresponds to the dimension of an opening 52 in the manifold 34, as illustrated in FIG. 2C. The manifold 34 in FIG. 2C is shown as being distanced from the tubing end 14 for illustrative purposes only. The present invention actually provides for the manifold 34 to be pushed up against the tooling means 20, as illustrated in FIG. 2D.

Continuing with FIG. 2D, as the end 14 of the sized tubing 12 exits the tooling means 20, the end 14 is inserted into the manifold 34 which is extended by the manifold actuator 30 of FIG. 1A until it is positioned against the tooling means 20. Insertion of the end 14 continues to a fixed depth or pressure, depending on the specific application. The insertion is controlled by the control means 42, as discussed previously in conjunction with FIG. 1B. Since the manifold 34 is held flush against the top and bottom tooling 22 and 24, as illustrated in FIG. 2D, the manifold 34 is installed square with the core of the tubing 12, which is necessary in order for the braze operation to be completed successfully.

Figure 3:
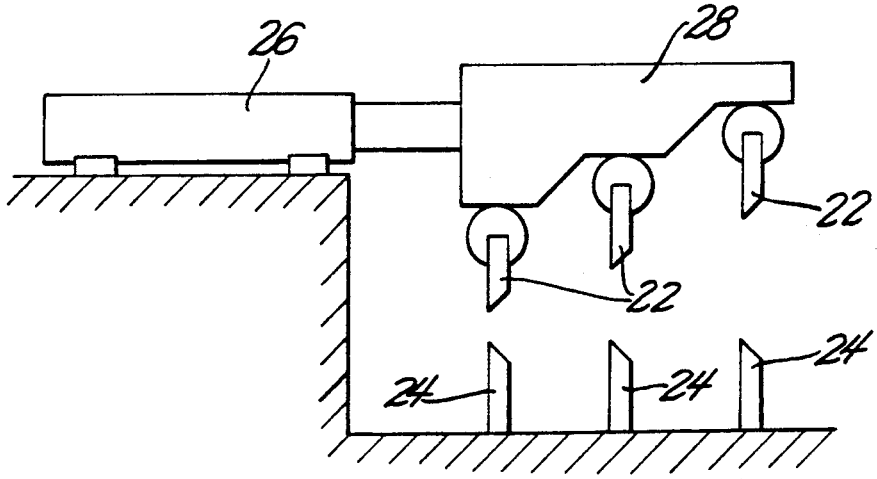
FIG. 3 illustrates a tooling means used for accomplishing the sizing operation in FIGS. 1A and 1B, and FIGS. 2A through 2D.

The tooling means 20 may be used with tubing 12 having ends 14 and 16 of virtually any perimeter dimension. This is accomplished using a split tooling design comprising the top tooling 22 and the bottom tooling 24. The bottom tooling 24, as discussed above in conjunction with FIG. 1A, is preferably not adjustable, while the position of the top tooling 24 is preferably adjustable. FIG. 3 illustrates the tooling means 20 used for accomplishing the sizing operation of the present invention. In FIG. 3, the top tooling 22 can be adjusted with the stepped cam 28, using a stepped design camming action or an equivalent action, to close or position the top tooling 22. A simple selector switch may be used to select the desired sizing height or perimeter dimension for each particular application. Although FIG. 3 is illustrated as being able to accommodate tubes of three different perimeter dimensions or heights, tubes of any height may be accommodated simply by adding additional steps for the stepped cam. Any suitable means may be used to position the cam, including the actuator 26, which closes the top tooling 22 sufficient to size the end or ends 14 of the tubing 12 to the desired dimension.

Figure 4A:
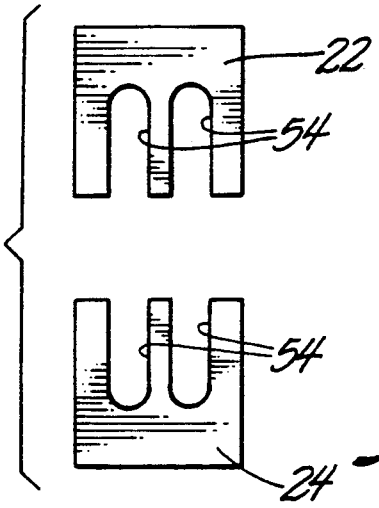
FIGS. 4A and 4B illustrate open and closed front views, respectively, of the top and bottom tooling of the tooling means in FIG. 3.
Figure 4B:
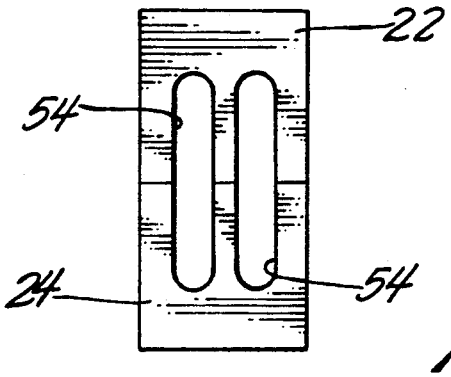

Referring now to FIGS. 4A and 4B, open and closed front views, respectively, of the top and bottom tooling 22 and 24 are illustrated. As can be seen, the top and bottom tooling 22 and 24 may have single or multiple chamfered openings 54, depending on whether the apparatus 10 is sizing tubing and installing manifolds for a single or a multi-pass heat exchanger. In FIGS. 4A and 4B, a multi-pass heat exchanger having two first ends 14 or two second ends 16 may be accommodated. Each single or multiple first end 14 or each single or multiple second end 16 is extruded to the desired perimeter dimension by a separate chamfered openings 54. The top and bottom tooling 22 and 24 remain separated or open until the tubing end or ends 14 or 16 are properly positioned between them. The top and bottom tooling 22 and 24 then meet or close to extrude the tubing ends 14 or 16 to the desired perimeter dimension, which is usually, although not necessarily, an oval shape. The ram cylinder 18 simultaneously pushes the tubing 12 with sufficient force to insert the ends 14 or 16 into the manifold 34. The top and bottom tooling 22 and 24 may be extended and retracted, via actuators 26 and 27, although the bottom tooling 24 preferably extends or closes to the same height every time, while the extension or height of the top tooling 22 is preferably adjustable.

The present invention provides for an apparatus and method for sizing tubing to a desired perimeter dimension and for positioning and installing a manifold. Tubing 12 is provided which has first and second ends, 14 and 16, respectively. First means, comprised of the tooling means 20 is then applied to simultaneously size the first end 14 of the tubing 12 to the first desired perimeter dimension, and position and install the first end 14 of the tubing 12 into a first manifold 34. Also, second means, also comprised of the tooling means 20, may be applied to simultaneously size the second end 16 of the tubing 12 to the second desired perimeter dimension, and position and install the second end 16 of the tubing into a second manifold 34 which is identical to the first manifold 34. The opening 38 of the first and second manifolds correspond to the first and second desired perimeter dimensions, respectively. The first means and the second means comprise adjustable tooling means 20 for sizing the tubing 12 and for positioning and installing the ends 14 and 16 of the tubing 12 into the manifolds 34.

Having described the invention in detail and by reference to the preferred embodiment thereof, it will be apparent that other modifications and variations are possible without departing from the scope of the invention defined in the appended claims.

What is claimed is:

1. A method for sizing tubing and for positioning and installing the tubing into a manifold, the method comprising the steps of:

providing tubing, said tubing having at least one first end and at least one second end; and applying first means for simultaneously sizing said at least one first end of said tubing to a first desired perimeter dimension, and positioning and installing said at least one first end of said tubing into a first manifold, said first manifold having a first opening corresponding to said first desired perimeter dimension.

2. A method as claimed in claim 1 further comprising the step of applying second means for simultaneously sizing said at least one second end of said tubing to a second desired perimeter dimension, and positioning and installing said at least one second end of said tubing into a second manifold, said second manifold having a second opening corresponding to said second desired perimeter dimension.

3. A method as claimed in claim 1 wherein said first means comprises:

first tooling means, said first tooling means including bottom tooling and top tooling, said bottom tooling being a fixed height and said top tooling being adjustable; and control means for positioning said at least one first end of said tubing for installation into said first manifold and for controlling insertion of said at least one first end of said tubing into said first manifold.

4. A method as claimed in claim 3 wherein said control means comprises:

stop means to aid in aligning said tubing prior to installation of said first manifold; and ejector means to aid in ejection of said tubing after installation of said first manifold.

5. A method as claimed in claim 2 wherein said second means comprises:

second tooling means, said second tooling means including bottom tooling and top tooling, said bottom tooling being a fixed height and said top tooling being adjustable; and control means for positioning said at least one second end of said tubing for installation into said second manifold and for controlling insertion of said at least one second end of said tubing into said second manifold.

6. A method as claimed in claim 5 wherein said control means comprises:

stop means to aid in aligning said tubing prior to installation of said second manifold; and ejector means to aid in ejection of said tubing after installation of said second manifold.

7. A method as claimed in claim 3 wherein said first tooling means further comprises a tapered section for insertion of said at least one first end of said tubing to extrude said tubing to said first desired dimension which corresponds to said first opening of said first manifold.

8. A method as claimed in claim 5 wherein said second tooling means further comprises a tapered section for insertion of said at least one second end of said tubing to extrude said tubing to said second desired dimension which corresponds to said second opening of said second manifold.

9. A method as claimed in claim 3 wherein said top tooling means is adjustable using a stepped design camming action to position said top tooling.

10. A method as claimed in claim 5 wherein said top tooling means is adjustable using a stepped design camming action to position said top tooling.

* * * * *